United States Patent [19]

Zückler

[11] Patent Number: 4,508,945

[45] Date of Patent: Apr. 2, 1985

[54] VACUUM SWITCHING INTERRUPTER WITH ANNULAR MEMBER AND DIAMETRICAL CONTACT WEB

[75] Inventor: Karl Zückler, Berlin, Fed. Rep. of Germany

[73] Assignee: Siemens Aktiengesellschaft, Munich, Fed. Rep. of Germany

[21] Appl. No.: 533,735

[22] Filed: Sep. 19, 1983

[30] Foreign Application Priority Data

Sep. 21, 1982 [DE] Fed. Rep. of Germany ..... 3235298

[51] Int. Cl.[3] ..... H01H 33/66

[52] U.S. Cl. ..... 200/144 B

[58] Field of Search ..... 200/144 B

[56] References Cited

U.S. PATENT DOCUMENTS 4,336,430 6/1982 Kurosawa et al. ..... 200/144 B 4,445,015 4/1984 Zückler ..... 200/144 B

FOREIGN PATENT DOCUMENTS 2429484 1/1976 Fed. Rep. of Germany ... 200/144 B

*Primary Examiner*—Robert S. Macon

*Attorney, Agent, or Firm*—Kenyon & Kenyon

[57] ABSTRACT

A vacuum switching arrangement is provided with contacts formed of an annular member and a diametrical web which is connected to a lead-in pin. Arms are provided at each of the contacts for coupling a contact plate to the annular member. The arms are arranged orthogonally distal with respect to the transverse web. The contact plate has an outside diameter which corresponds approximately to the inside diameter of the annular member. The contacts in accordance with the invention are easily manufactured and produce an axial magnetic field on the entire contact area with a polarity which changes from quadrant to quadrant. Such contacts are particularly suited for use in circuit breakers.

3 Claims, 3 Drawing Figures

VACUUM SWITCHING INTERRUPTER WITH ANNULAR MEMBER AND DIAMETRICAL CONTACT WEB

BACKGROUND OF THE INVENTION

This invention relates generally to vacuum switching tubes of the type which have two contacts which can be moved with respect to one another, each contact having an annular member and a diametrical web which connects the annular member to a lead-in post. Such a switching tube interrupter is further provided with a contact plate in the form of a cylindrical washer which is connected to the annular member by projections emanating therefrom in a mechanically sound and electrically conducting manner.

A vacuum switching interrupter of the type discussed herein is described in U.S. Pat. No. 4,336,430. The operation of this known arrangement is based on generating a magnetic field which is oriented axially with respect to the axis of the contact arrangement and counteracts a contraction of the switching arc in the switching of large currents. As a result, the arcs remain diffused and cannot cause heavy local burn-off at the contact plates. It is a problem with such known arrangements that, as a result of their being designed from a pluality of parts, such contacts are relatively difficult to produce.

It is, therefore, an object of this invention to improve the producibility and effectiveness of vacuum switching contacts.

SUMMARY OF THE INVENTION

The foregoing and other objects are achieved by this invention which provides a contact plate at each of the contacts which is made without slots and has a smaller diameter than the annular member. The projections are designed as arms which are brought to the edge of the contact plates. By omitting the slots, the mechanical stability of the contact plate is increased. Although a less predictable current distribution is obtained because of the absence of the slots, improve operation over known arrangements is assured by the fact that a larger portion of the area of the contact plate is permeated by the axial magnetic field. The manetic field at the outer circumference of the contact plate is very weak because the field is present in its full magnitude only at the inner circumference of the annular member. It has been discovered to be equally advantageous from the standpoint of effectiveness and producibility if the outside diameter of the contact plate corresponds approximately to the inside diameter of the annular member. With such a design of the contact plate and the annular member, the axial magnetic field is present in its full magnitude at the edge of the contact plate. Simultaneously, the annular member and the contact plate can be produced as a unified body, illustratively as a casting.

It is known to provide vacuum switching tube interrupters of the type having an annular member for each contact and a diametrical web, with arms which extend at right angles thereto and almost to the diametrical web where the contact plate is arranged (IEEE Trans. Power Apparatus & Systems, vol. PAS 99, 6 (1980), pages 2079 to 2085). Also in this arrangement, the axial magnetic field is sudivided into four quadrants of mutually opposite polarity. Advantageously, the residual magnetic field of the contact plate at the time of the zero crossing of the current is attenuated. This facilitates the quenching of the arc since the remaining charge carriers can diffuse away more quickly if they are no longer deflected magnetically. On the other hand, the mechanical design of this known contact arrangement is more complicated and less resistant to stress than the present invention.

In accordance with a further embodiment of the invention, two contacts designed in accordance with the invention can be arranged oppositely to one another and guided in such a manner that the diametrical webs of the ring members cross at right angles. This is achieved in such a manner that the magnetic fields generated by the contacts of the same direction everywhere and consequently, attraction forces result. Accordingly, undesired lifting of the contact under the influence of surge currents is provided.

BRIEF DESCRIPTION OF THE DRAWINGS

Comprehension of the invention is facilitated by reading the following detailed description in conjunction with the annexed drawings, in which.

DETAILED DESCRIPTION

Figure 1:
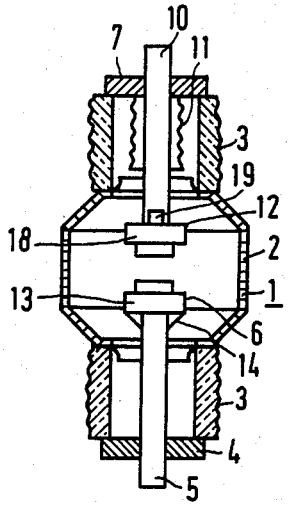
FIG. 1 is a cross-sectional side view of a vacuum switching apparatus constructed in accordance with the principles of the invention.

FIG. 1 shows a vacuum switching apparatus 1 having a central metal cylinder 2 and insulating bodies 3 adjacent thereto on both sides. A lead-in pin 5 is connected to a lower terminating plate 4, lead-in pin 5 having an outer end which can be connected to a terminal device for the circuit to be switched. A stationary contact 6 having an annular member 13 and a diametrical web 14 is arranged to be stationary at the inner end of lead-in pin 5. Upper insulating body 3 is provided with a further terminating plate 7 in which a further lead-in pin 10 is guided movably in the axial direction. An accordion bellows 11 having one end thereof connected to terminating plate 7, and its other end to lead-in pin 10 is provided for sealing the vacuum switching arrangement 1 against the environment. Depending upon the chosen design of the parts, the electrical connection to terminating plate 7 or to the outer end of lead-in pin 10 can be made in a manner which is well known. At the inner end of lead-in pin 10 there is provided a movable contact 12 which also has an annular member 18 and a diametrical web 19. Diametrical webs 14 and 19 can also be referred to as "transverse webs."

Figure 2:
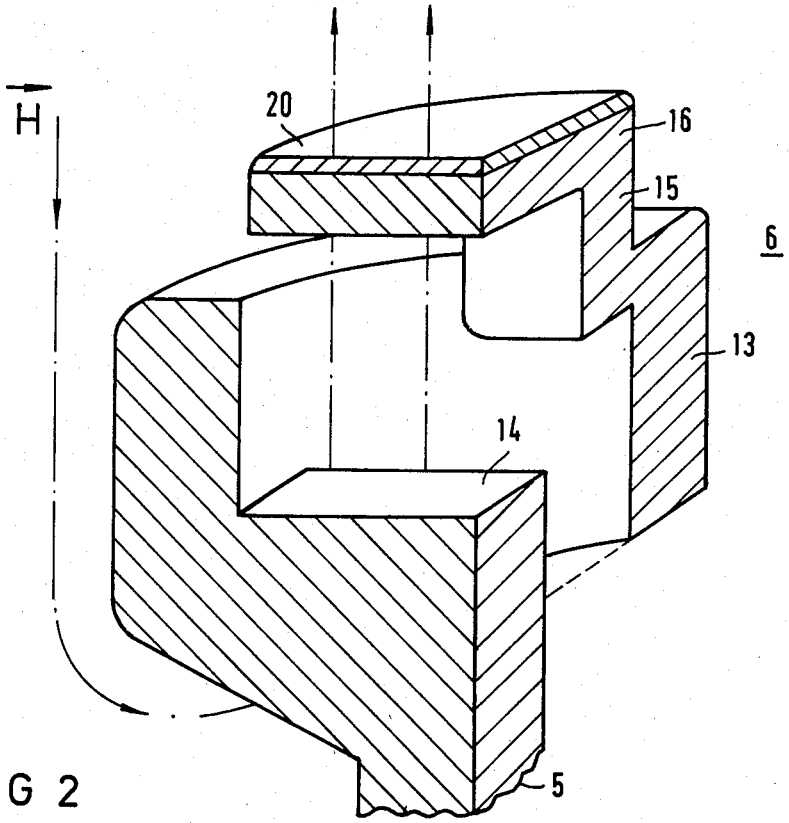
FIG. 2 is an isometric view of one-quarter of the contacts shown in FIG. 1.

FIG. 2 shows a one-quarter section of contact 6 in the embodiment of FIG. 1, in an isometric representation. As will be seen, contact 6 has an annular member 13 which is in contact with lead-in pin 5 via a transverse web 14. Transverse web 14 is arranged lower than annular member 13 and has about one-half of the height thereof. At its underside, transverse web 14 is beveled toward lead-in pin 5 for structural strength. An angle-off arm 15 is arranged at right angles to transverse web 14 starting from the upper rim of annular member 13 and forming a connection to a contact plate 16. It should be noted that a further arm 17 is provided, but is not visible in this figure as a result of the one-quarter isometric representation. However, further arm 17 is visible in FIG. 3.

Figure 3:
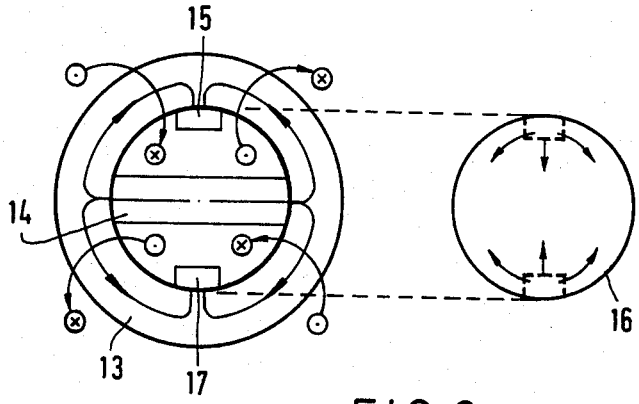
FIG. 3 is an exploded top view of a ring member of a contact and a corresponding contact plate showing the directions of the magnetic fields.

As shown in FIGS. 2 and 3, contact plate 16 is designed so that its underside diameter corresponds to the inside diameter of annular member 13. Contact plate 16 is provided with an overlay 20 which is particularly well suited for switching in a vacuum, as is well known, and may preferably consist of a composite chromium/-copper material.

In the following, the operation of the inventive vacuum switching apparatus will be described. A current which is assumed to enter lead-in pin 5 from below is distributed via transverse web 14 in accordance with the arrows shown in FIG. 3. The current arrives at contact plate 16 via arms 15 and 17 which act as the feeding point. In this manner, the direction of the current within annular member 13 changes from quadrant to quadrant so that axially directed magnetic fields are generated, the directions of which change likewise from quadrant to quadrant. Direction of the currents and of the magnetic field are essentially independent of the point at which the arc stands between contact plate 16 or contact overlay 20 of contacts 6 and 12 during the switching operation. An exception to this arises in the situation where a switching arc is generated directly above one of the feed points, i.e., at the feed point of one of arms 15 or 17 into contact plate 16. In this case, the entire current flows only via the one-half of annular member 13. The detrimental consequences of firing the arc at these points are prevented, however, by the provision that the cooperating contacts 6 and 12 are mounted rotated with respect to each other by 90°. This is shown in FIG. 1 wherein the position of transverse web 14 of contact 6 and transverse web 19 of contact 12 are transverse to one another. This structure provides the advantage that the arc is subjected to the action of the radial magnetic field which is generated by the transverse web of the opposite contact and which moves the arc and prevents the contact material from melting excessively.

The offsetting of the cooperating contacts by 90° provides the further advantage that the currents flowing in the same direction exist in respective opposite quadrants of the annular members of the contacts. As a result, the contacts attract each other, thereby preventing lifting of the contacts under the influence of surge currents. Moreover, the desired axial magnetic field prevails in the entire space between the contacts. This magnetic field is also fully effective at the outer rim of contact plates 16 because the diameter of the contact plates approximately corresponds to the inside diameter of the annular members.

The relatively simple form of the present inventive contacts makes possible an economical manufacturing of the arrangement using known manufacturing methods. In accordance with a further embodiment of the invention, the contacts can be made, for example, as one-piece castings to which only the contact overlays need to be applied. However, two-piece manufacturing is also possible, illustratively in embodiments where the annular member with the transverse web and the arms is made as a casting to which the contact plate is subsequently fastened.

Although the invention has been described in terms of specific embodiments and applications, persons skilled in the art, in light of this teaching, can generate additional embodiments without exceeding the scope or departing from the spirit of the claimed invention. Accordingly, the drawings and descriptions in this disclosure are proffered to facilitate comprehension of the invention and should not be construed to limit the scope thereof.

What is claimed is:

1. A vacuum switching arrangement of the type having two contacts which are movable with respect to one another, each contact having an annular member and a diametrical web for connecting the annular member to a lead-in pin, the contact further comprising:

a contact plate in the form of a cylindrical washer, said contact plate being made slotless and having a diameter smaller than the annular member; and a pair of projections arranged as arms for mechanically and electrically coupling said contact plate and the annular member to one another.

2. The apparatus of claim 1 wherein the outside diameter of said contact plate corresponds approximately to the inside diameter of the annular member.

3. The apparatus of claim 1 wherein a pair of the contacts are arranged opposite to one another and guided in such a manner that the diametrical webs of the respective contacts are arranged at right angles to one another.

* * * * *